US009800982B2

(12) United States Patent
Andersson et al.

(10) Patent No.: US 9,800,982 B2
(45) Date of Patent: Oct. 24, 2017

(54) ELECTROMAGNETIC TRANSDUCER WITH EXPANDED MAGNETIC FLUX FUNCTIONALITY

(71) Applicant: COCHLEAR LIMITED, NSW (AU)

(72) Inventors: Marcus Andersson, Molnlycke (SE); Johan Gustafsson, Molnlycke (SE); Kristian Asnes, Molnlycke (SE)

(73) Assignee: Cochlear Limited, Macquarie University, NSW (AU)

( * ) Notice: Subject to any disclaimer, the term of this patent is extended or adjusted under 35 U.S.C. 154(b) by 230 days.

(21) Appl. No.: 14/308,654

(22) Filed: Jun. 18, 2014

(65) Prior Publication Data

US 2015/0373461 A1 Dec. 24, 2015

(51) Int. Cl.
*H04R 25/00* (2006.01)
*H04R 9/02* (2006.01)

(52) U.S. Cl.
CPC ..... *H04R 25/606* (2013.01); *H04R 9/025* (2013.01); *H04R 2225/67* (2013.01); *H04R 2460/13* (2013.01)

(58) Field of Classification Search
CPC ..... H04R 9/025–9/027; H04R 2460/13; H04R 24/608; H04R 25/606; H04R 2225/67; H01R 35/606; H01R 2225/67
USPC ..... 600/25; 381/151, 380, 331, 326
See application file for complete search history.

(56) References Cited

U.S. PATENT DOCUMENTS

| | | | | |
|---|---|---|---|---|
| 2,402,392 | A * | 6/1946 | Goldschmidt | H04R 11/00 381/151 |
| 4,581,491 | A | 4/1986 | Boothroyd | |
| 5,935,170 | A | 8/1999 | Håkansson et al. | |
| 6,217,508 | B1 * | 4/2001 | Ball | H04R 11/02 600/25 |
| 8,139,800 | B2 | 3/2012 | Ho et al. | |
| 8,406,443 | B2 | 3/2013 | Westerkull et al. | |
| 2003/0034705 | A1 * | 2/2003 | Hakansson | H04R 9/025 310/81 |
| 2004/0057588 | A1 * | 3/2004 | Asnes | H04R 25/606 381/151 |
| 2004/0210103 | A1 | 10/2004 | Westerkull | |
| 2006/0042866 | A1 | 3/2006 | Widmer et al. | |
| 2006/0045298 | A1 * | 3/2006 | Westerkull | H02K 33/18 381/326 |
| 2006/0050913 | A1 | 3/2006 | Westerkull | |

(Continued)

FOREIGN PATENT DOCUMENTS

| | | | |
|---|---|---|---|
| JP | 2010075394 | A | 4/2010 |
| WO | 02/09622 | A1 | 2/2002 |

OTHER PUBLICATIONS

"Electrical Engineering and Projects." : Electronics Tutorial about Magnetism. N.p., Feb. 8, 2013. Web. Feb. 16, 2016.*

(Continued)

*Primary Examiner* — Charles A Marmor, II
*Assistant Examiner* — Thaddeus Cox
(74) *Attorney, Agent, or Firm* — Hauptman Ham, LLP; Martin J. Cosenza

(57) ABSTRACT

An apparatus, including an external component of a medical device including an electromagnetic actuator configured such that static magnetic flux of the electromagnetic actuator removably retains the external component to a recipient thereof.

26 Claims, 10 Drawing Sheets

(56) References Cited

U.S. PATENT DOCUMENTS

2007/0041595 A1* 2/2007 Carazo ..... H04R 17/00 381/151
2007/0053536 A1* 3/2007 Westerkull ..... H04R 25/606 381/326
2009/0024183 A1 1/2009 Fitchmun
2009/0082817 A1 3/2009 Jinton et al.
2009/0245553 A1* 10/2009 Parker ..... H04R 25/70 381/326
2010/0145135 A1* 6/2010 Ball ..... H04R 25/606 600/25
2010/0286776 A1 11/2010 Andersson
2010/0292529 A1 11/2010 Westerkull et al.
2012/0078035 A1 3/2012 Andersson et al.
2012/0172658 A1 7/2012 Björn et al.
2012/0237067 A1 9/2012 Asnes
2013/0018218 A1* 1/2013 Haller ..... H04R 25/60 600/25
2013/0090518 A1 4/2013 Björn et al.
2013/0195304 A1* 8/2013 Andersson ..... H04R 25/606 381/326
2014/0012069 A1* 1/2014 Ball ..... H04R 25/00 600/25
2014/0012071 A1* 1/2014 Nagl ..... H04R 25/00 600/25
2014/0121450 A1* 5/2014 Kasic ..... H04R 25/60 600/25
2014/0179985 A1 6/2014 Andersson

OTHER PUBLICATIONS

Cosenza, Martin, "Believed 102 Art", believed to be known or used by others in the U.S. before Oct. 2013.

* cited by examiner

ELECTROMAGNETIC TRANSDUCER WITH EXPANDED MAGNETIC FLUX FUNCTIONALITY

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc, or for individuals who suffer from stuttering problems.

SUMMARY

In accordance with one aspect, there is an apparatus comprising an external component of a medical device including an electromagnetic actuator configured such that static magnetic flux of the electromagnetic actuator removably retains the external component to a recipient thereof.

In accordance with another aspect, there is an apparatus, comprising a bone conduction device, including an electromagnetic actuator including two permanent magnets that generate static magnetic flux and that are aligned with one another at least about at a same location along a longitudinal axis of the actuator and arranged such that respective North-South poles face opposite directions relative to the longitudinal axis.

In accordance with another aspect, there is a passive transcutaneous bone conduction device including an electromagnetic actuator configured to generate a static magnetic flux and a dynamic magnetic flux that interacts with the static magnetic flux to actuate the actuator, wherein the device includes an external component configured to generate the dynamic magnetic flux, and the device includes an internal component configured to generate at least a portion of the static magnetic flux.

BRIEF DESCRIPTION OF THE DRAWINGS

Some embodiments are described below with reference to the attached drawings, in which.

DETAILED DESCRIPTION

Figure 1:
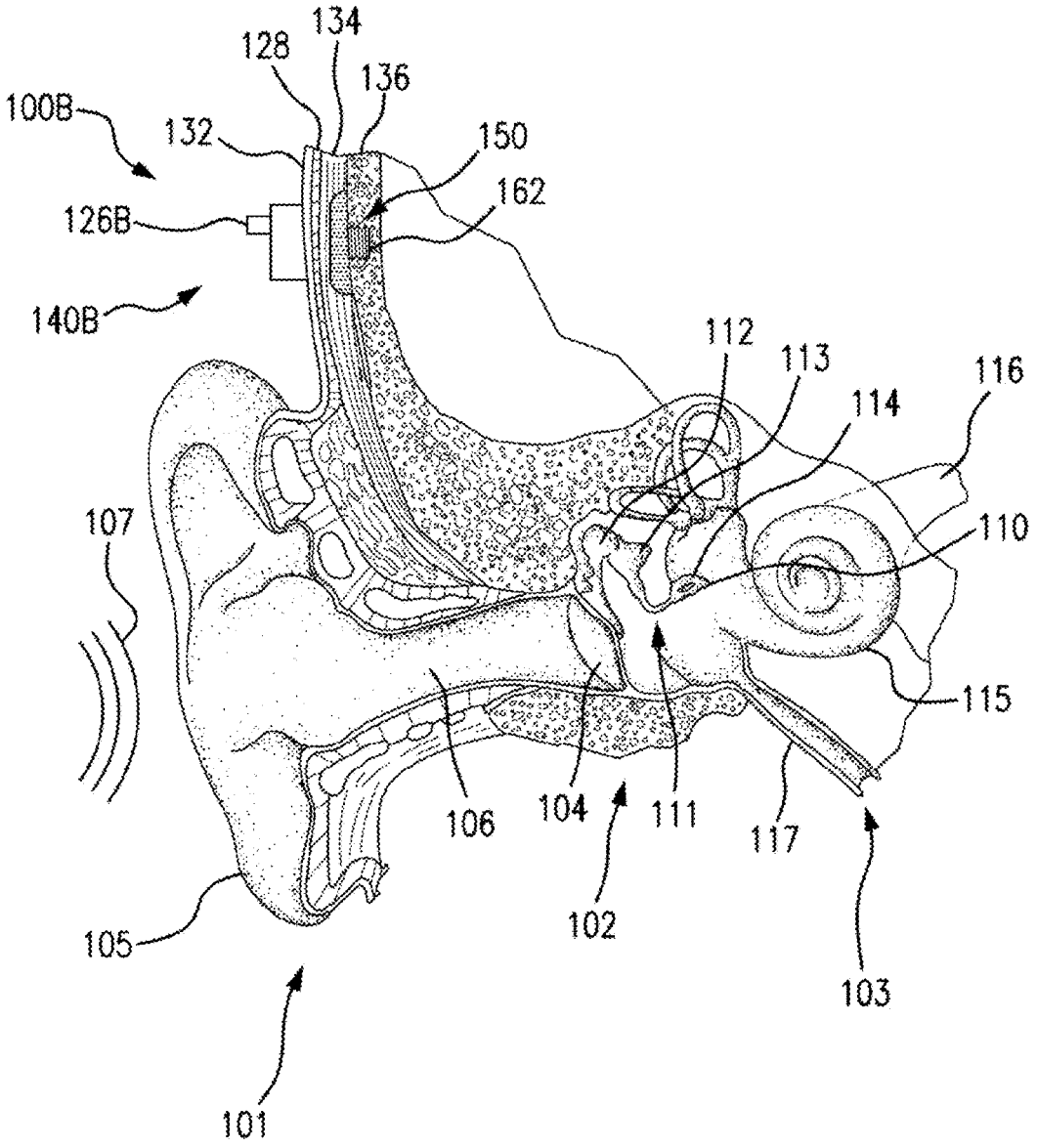
FIG. 1 is a perspective view of an exemplary bone conduction device in which at least some embodiments can be implemented.

FIG. 1 is a perspective view of a bone conduction device 100 in which embodiments may be implemented. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. As shown, bone conduction device 100 is positioned behind outer ear 101 of the recipient and comprises a sound input element 126 to receive sound signals. Sound input element may comprise, for example, a microphone, telecoil, etc. In an exemplary embodiment, sound input element 126 may be located, for example, on or in bone conduction device 100, or on a cable extending from bone conduction device 100.

The bone conduction device 100 of FIG. 1 is a passive transcutaneous bone conduction device utilizing the electromagnetic actuators disclosed herein and variations thereof where no active component (e.g., the electromagnetic actuator) is implanted beneath the skin (it is instead located in an external device), and the implantable part is, for instance a magnetic pressure plate (a permanent magnet, ferromagnetic material, etc.). Some embodiments of the passive transcutaneous bone conduction systems are configured for use where the vibrator (located in an external device) containing the electromagnetic actuator is held in place by pressing the vibrator against the skin of the recipient. In an exemplary embodiment, the vibrator is held against the skin via a magnetic coupling (magnetic material and/or magnets being implanted in the recipient and the vibrator having a magnet and/or magnetic material that used to complete the magnetic circuit, thereby coupling the vibrator to the recipient).

More specifically, FIG. 1 is a perspective view of a passive transcutaneous bone conduction device 100 in which embodiments can be implemented.

Bone conduction device 100 comprises an external component 140 and implantable component 150. Bone conduction device 100 comprises a sound processor (not shown), an actuator (also not shown) and/or various other operational components. In operation, sound input device 126 converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with some embodiments, a fixation system 162 may be used to secure implantable component 150 to skull 136. As described below, fixation system 162 may be a bone screw fixed to skull 136, and also attached to implantable component 150.

In one arrangement of FIG. 1, bone conduction device 100 is a passive transcutaneous bone conduction device. In such an arrangement, the active actuator is located in external component 140, and implantable component 150 includes a plate, as will be discussed in greater detail below. The plate of the implantable component 150 vibrates in response to vibration transmitted through the skin, mechanically and/or via a magnetic field, that are generated by an external magnetic plate.

Figure 2:
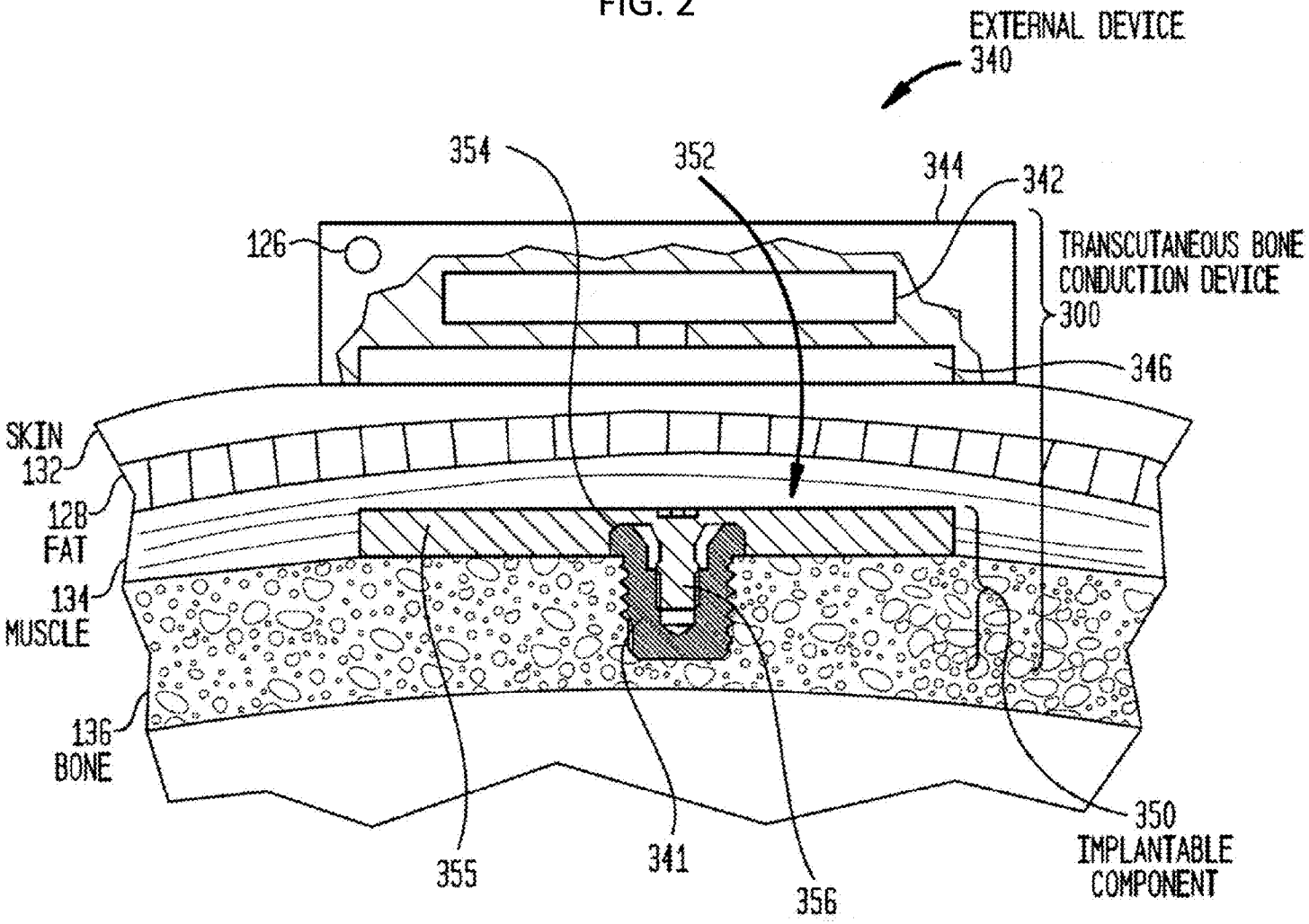
FIG. 2 is a schematic diagram conceptually illustrating a passive transcutaneous bone conduction device in accordance with at least some exemplary embodiments.
Figure 3:
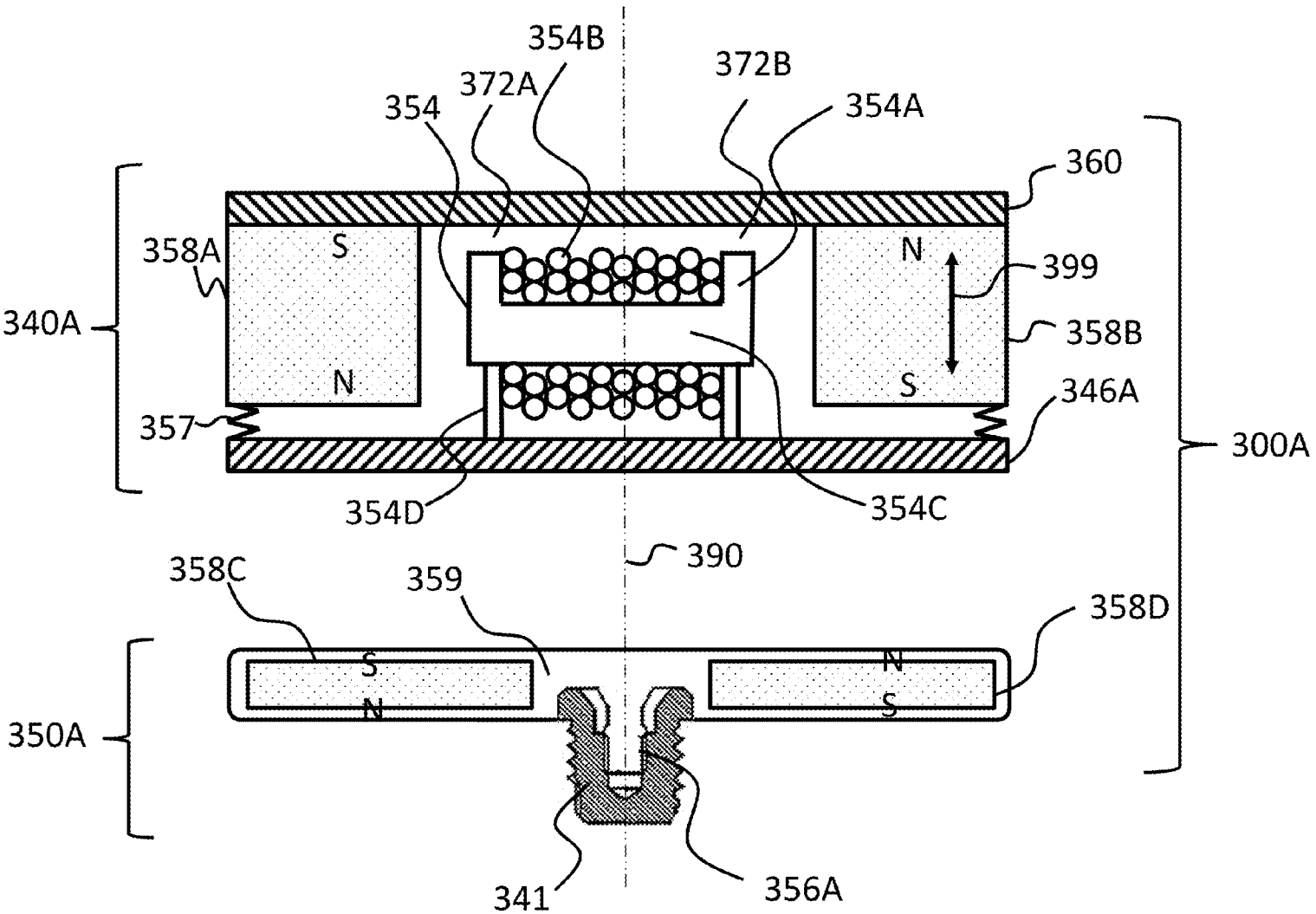
FIG. 3 is a schematic diagram illustrating additional details of the embodiment of FIG. 2.

FIG. 2 depicts a functional schematic of an exemplary embodiment of a transcutaneous bone conduction device 300 according to an embodiment that includes an external device 340 (corresponding to, for example, element 140 of FIG. 1) and an implantable component 350 (corresponding to, for example, element 150 of FIG. 1). The transcutaneous bone conduction device 300 of FIG. 3 is a passive transcutaneous bone conduction device in that a vibrating electromagnetic actuator 342 is located in the external device 340. Vibrating electromagnetic actuator 342 is located in housing 344 of the external component, and is coupled to plate 346. In an exemplary embodiment, the vibrating electromagnetic actuator 342 is a device that converts electrical signals into vibration. In operation, sound input element 126 converts sound into electrical signals. Specifically, the transcutaneous bone conduction device 300 provides these electrical signals to vibrating actuator 342, or to a sound processor (not shown) that processes the electrical signals, and then provides those processed signals to vibrating electromagnetic actuator 342. The vibrating electromagnetic actuator 342 converts the electrical signals (processed or unprocessed) into vibrations. Because vibrating electromagnetic actuator 342 is mechanically coupled to plate 346, the vibrations are transferred from the vibrating actuator 342 to plate 346. Implanted plate assembly 352 is part of the implantable component 350, and is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient, as will be detailed further below. Accordingly, vibrations produced by the vibrating electromagnetic actuator 342 of the external device 340 are transferred from plate 346 across the skin to plate 355 of implanted plate assembly 352. This can be accomplished as a result of mechanical conduction of the vibrations through the skin, resulting from the external device 340 being in direct contact with the skin and/or from the magnetic field between the two plates. These vibrations are transferred without penetrating the skin with a solid object such as an abutment as detailed herein with respect to a percutaneous bone conduction device.

As may be seen, the implanted plate assembly 352 is substantially rigidly attached to a bone fixture 341 in this embodiment. Plate screw 356 is used to secure plate assembly 352 to bone fixture 341. The portions of plate screw 356 that interface with the bone fixture 341 substantially correspond to an abutment screw discussed in some additional detail below, thus permitting plate screw 356 to readily fit into an existing bone fixture used in a percutaneous bone conduction device. In an exemplary embodiment, plate screw 356 is configured so that the same tools and procedures that are used to install and/or remove an abutment screw (described below) from bone fixture 341 can be used to install and/or remove plate screw 356 from the bone fixture 341 (and thus the plate assembly 352).

In an exemplary embodiment, there is an apparatus comprising an external component 340 of a medical device (e.g., the transcutaneous bone conduction device 300 of FIG. 2), where the external component includes an electromagnetic actuator. The external component 340 is configured such that static magnetic flux of the electromagnetic actuator removably retains the external component 340 to a recipient thereof. Thus, in an exemplary embodiment, the permanent magnets of the transducer have one or more (including all) of the following functions: the establishment of a magnetic holding force to hold the external component to the recipient; the function of a counterweight mass of the actuator; and the traditional role of generating a static magnetic field that is used by the actuator in combination with the dynamic magnetic field that is generated to actuate the actuator.

More specifically, referring now to FIG. 3, which depicts a schematic of an exemplary bone conduction device 300A corresponding to bone conduction device 300 of FIG. 2, the exemplary bone conduction device 300A having the aforementioned static magnetic flux features and includes an external component 340A corresponding to external component 340 of FIG. 2, and an implantable component 350A corresponding to implantable component 340 of FIG. 2.

In an exemplary embodiment, external component 340A has the functionality of a transducer/actuator, irrespective of whether it is used with implantable component 350A. That is, in some exemplary embodiments, external component 340A will vibrate whether or not the implantable component 350A is present (e.g., whether or not the static magnetic field extends to the implantable component 350A, as will be detailed below).

The external component 340A includes a vibrating electromagnetic actuator established by elements 354, 360, 358A and 358B, 357 and 346A, and, in some embodiments, 350A. Element 360 is a yoke, which, in an exemplary embodiment, can be a soft iron plate (any other type of material that can enable the teachings detailed herein and/or variations thereof can be used in at least some embodiments). Element 358A is a permanent magnet having a North-South alignment in a first direction relative to a longitudinal axis 390 of the electromagnetic actuator (the vertical direction of FIG. 3—which is parallel to the direction of movement of components of the actuator during actuation thereof, indicated by arrow 390, as will be detailed below). Element 358B is a permanent magnet having a North-South alignment in a second direction relative to a longitudinal axis of the electromagnetic actuator, the second direction being opposite the first direction. In an exemplary embodiment, the permanent magnets are bar magnets (having a longitudinal direction extending normal to the plane of FIG. 3). In some embodiments, the bar magnets have hogged-out sections in the center to accommodate the bobbin assembly (e.g., they can be "C" shaped bar magnets). In some embodiments, the magnets can be half-moon magnets or crescent moon magnets. In alternative embodiments, other configurations of the magnets can be utilized. For example, the magnets can have hogged-out sections that accommodate the springs, depending on the geometry. Any configuration of permanent magnet(s) that can enable the teachings detailed herein and/or variations thereof to be practiced can be utilized in at least some embodiments.

Accordingly, in view of the above, in an exemplary embodiment, there is a bone conduction device 300A, including an electromagnetic actuator including two permanent magnets 358A and 358B that generate static magnetic flux aligned with one another at least about at a same location along a longitudinal axis 390 of the actuator (i.e., at the same level relative to the vertical direction of FIG. 3) arranged such that respective North-South poles of the permanent magnets face opposite directions relative to the longitudinal axis 390.

Elements 357 are springs that supports the assembly of permanent magnets 358A and 358B and the yoke 360. It is noted that the springs 357 is depicted in a functional matter. That is, in at least some embodiments, spring 357 is a leaf spring that extends from the permanent magnets (or a spacer connected to the permanent magnets) to a location closer towards the center (e.g., closer towards the longitudinal axis of the external component 340, such as to element 354D). An exemplary embodiment of this is described below. That said, in an alternate embodiment, helical springs can be utilized. Also, it is noted that the locations of the Springs can be different than that depicted in the figures. By way of example only and not by way limitation, in an exemplary embodiment, springs 357 can be located such that they extend between the plate 346A and the yoke 360 (e.g. running between the respective permanent magnets and the bobbin assembly). Any device, system, and/or method that can enable a spring system to be established can be utilized in at least some embodiments.

Collectively, elements 357, 358A, 358B and 360 make up a counterweight assembly (also referred to herein as a seismic mass). The actuator generates force by moving/accelerating (including negative acceleration) the seismic mass.

The vibrating electromagnetic actuator further includes support plate assembly which is made up of elements 354 and 346A. When the electromagnetic actuator is actuated, the counterweight assembly moves relative to the support plate assembly, as will be further detailed below. The bobbin assembly 354 is made up of elements 354A, 354B, 354C and 354D. Element 354A is a bobbin, element 354B is a coil that is wrapped around a core 354C of bobbin 354A. Element 354D is a coupling that couples the bobbin core 354C to support plate 346D. In at least some embodiments, element 354D is made of non-ferromagnetic material, as contrasted to the bobbin 354A, which can be made of, for example, soft iron, etc. In the illustrated embodiment, bobbin assembly 354 is radially asymmetrical (some exemplary ramifications of such are described in greater detail below). That said, in the illustrated embodiment, the coils 354B and the bobbin core 354C are circular relative to a plane parallel to axis 390 and normal to the plane of the FIG. 3. Alternatively, in an alternative embodiment, the coils 354B and the bobbin core 354C are radially asymmetrical (oval shaped, rectangular shaped, etc.). Any configuration of the bobbin assembly that can enable the teachings detailed herein and/or variations thereof to be practiced can be utilized in at least some embodiments.

Support plate 346A is a plate that includes a bottom surface (relative to the frame of reference of FIG. 3) that is configured to interface with the exterior skin of the recipient. In this regard, support plate 346A corresponds to plate 346 of FIG. 2 as described above. It is through plate 346A that vibrations generated by the electromagnetic actuator of the external component 340A are transferred from the external component 340A to the skin of the recipient to evoke a hearing percept. In an exemplary embodiment, support plate 346A is made of a non-ferromagnetic material that is compatible with skin of the recipient (or at least is coated with a material that is compatible with skin of the recipient). In at least some exemplary embodiments, the plate 346A is free of any permanent magnet components. In this regard, in at least some exemplary embodiments, the plate 346A is configured to substantially avoid influencing the magnetic flux generated by the permanent magnets. Accordingly, in at least some embodiments, the plate 346A has utility in that the wage and or volume of the removable component 340A can be reduced relative to embodiments that include a permanent magnet and/or as part of the support plate assembly 346A to establish a magnetic force with the implantable component.

Indeed, in at least some exemplary embodiments, such a configuration can have utility in that the second resonance of the bone conduction device can be increased relative to that which would be the case if a permanent magnet was utilized within or in the plate 346A. In at least some exemplary embodiments, this can have utility in that sound transmission quality is substantially improved relative to that which would be the case in the alternate configuration just detailed. In an exemplary embodiment, an exemplary bone conduction device can have a cut-off frequency of about 8 kHz (as compared to about 4 kHz of bone conduction devices according to the alternate configuration). By way of example only and not by way of limitation, in at least some exemplary embodiments, there is a bone conduction device according to one or more or all of the teachings detailed herein and/or variations thereof that has a cut-off frequency of about 5 kHz or more, 6 kHz, 7 kHz or about 8 kHz or more or any value or range of values therebetween in about 100 Hz increments (e.g., about 5.7 kHz or more, about 5.2 kHz to about 7.9 kHz, etc.).

Spring 357 connects the support plate assembly to the rest of counterweight assembly, and permits counterweight assembly to move relative to bobbin assembly 354 and the support plate 346A (the support plate assembly) upon interaction of a dynamic magnetic flux with the static magnetic flux, produced by bobbin assembly 354.

Coil 354B, in particular, may be energized with an alternating current to create the dynamic magnetic flux about coil 354B. As may be seen, the vibrating electromagnetic actuator includes two air gaps 372A and 372B that are located between bobbin assembly 354 and plate 360. With respect to the arrangement of FIG. 3, air gaps 372A and 372B extend in the direction of relative movement between the support plate assembly and the counterweight assembly, as indicated by arrow 399. In the electromagnetic actuator depicted in FIG. 3, the air gaps 372A and 372B close static magnetic flux between the bobbin 354A and the yoke 360, respectively. It is further noted that air gaps 372A and 372B are radial relative to the relative to the dynamic magnetic flux magnetic axis of the electromagnetic actuator (discussed in greater detail below).

It is noted that the phrase "air gap" refers to locations along the flux path in which little to no material having substantial magnetic aspects is located but the magnetic flux still flows through the gap. The air gap closes the magnetic field. Accordingly, an air gap is not limited to a gap that is filled by air.

In the exemplary embodiment of FIG. 3, there are no axial air gaps (relative to the dynamic magnetic flux magnetic axis of the electromagnetic actuator, as discussed below). That said, in an alternate embodiment, axial air gaps can also be included.

FIG. 3 also depicts an implantable component 350A corresponding to implantable component 350 of FIG. 2. In some embodiments, implantable component 350 includes at least two permanent magnets 358C and 358D. Permanent magnet 358C has a North-South alignment in a first direction relative to a longitudinal axis of the electromagnetic actuator (the vertical direction of FIG. 3). Permanent magnet 358D has a North-South alignment in a second direction relative to a longitudinal axis of the electromagnetic actuator, the second direction being opposite the first direction. In an exemplary embodiment, the permanent magnets are bar magnets (having a longitudinal direction extending normal to the plane of FIG. 3). In at least some exemplary embodiments, during operational use of the bone conduction device 300A, the external component 340A is aligned with the implantable component 350A such that the poles of the permanent magnets 358A and 358C have a North-South alignment in the same direction and the poles of the permanent magnets 358B and 358D have a North-South alignment in the same direction (but opposite of that of magnets 358A and 358C). In at least some exemplary embodiments, permanent magnets 358C and 358D are bar magnets connected to one another via chassis 359 of the implantable component 350A. In an exemplary embodiment, the chassis 359 is a nonmagnetic material (e.g., titanium). In alternative embodiments, other configurations the magnets can be utilized. Any configuration permanent magnet that can enable the teachings detailed herein and/or variations thereof to be practiced can be utilized in at least some embodiments.

That said, in an alternative embodiment, it is noted that the implantable component 350A does not include permanent magnets. In at least some embodiments, elements 358C and 358D are replaced with other types of ferromagnetic material (e.g. soft iron (albeit encapsulated in titanium, etc.)). Also, elements 358C and 358D can be replaced with a single, monolithic component. Any configuration of ferromagnetic material of the implantable component 350A that will enable the permanent magnets of the external component 340A to establish a magnetic coupling with the implantable component 350A that will enable the external component 340A to be adhered to the surface of the skin as detailed herein can be utilized in at least some embodiments.

In operation, sound input element 126 (FIG. 1) converts sound into electrical signals. As noted above, the bone conduction device provides these electrical signals to a sound processor which processes the signals and provides the processed signals to the vibrating electromagnetic actuator of external component 340A (and/or any other electromagnetic actuator detailed herein and/or variations thereof—it is noted that unless otherwise specified, any teaching herein concerning a given embodiment is applicable to any variation thereof and/or any other embodiment and/or variations thereof), which then converts the electrical signals (processed or unprocessed) into vibrations. Because the vibrating electromagnetic actuator of external component 340A is mechanically coupled to plate 346A, the vibrations are transferred from the vibrating electromagnetic actuator to coupling assembly plate 346A and then to the recipient via the plate 346A, to evoke a hearing percept.

Figure 4A:
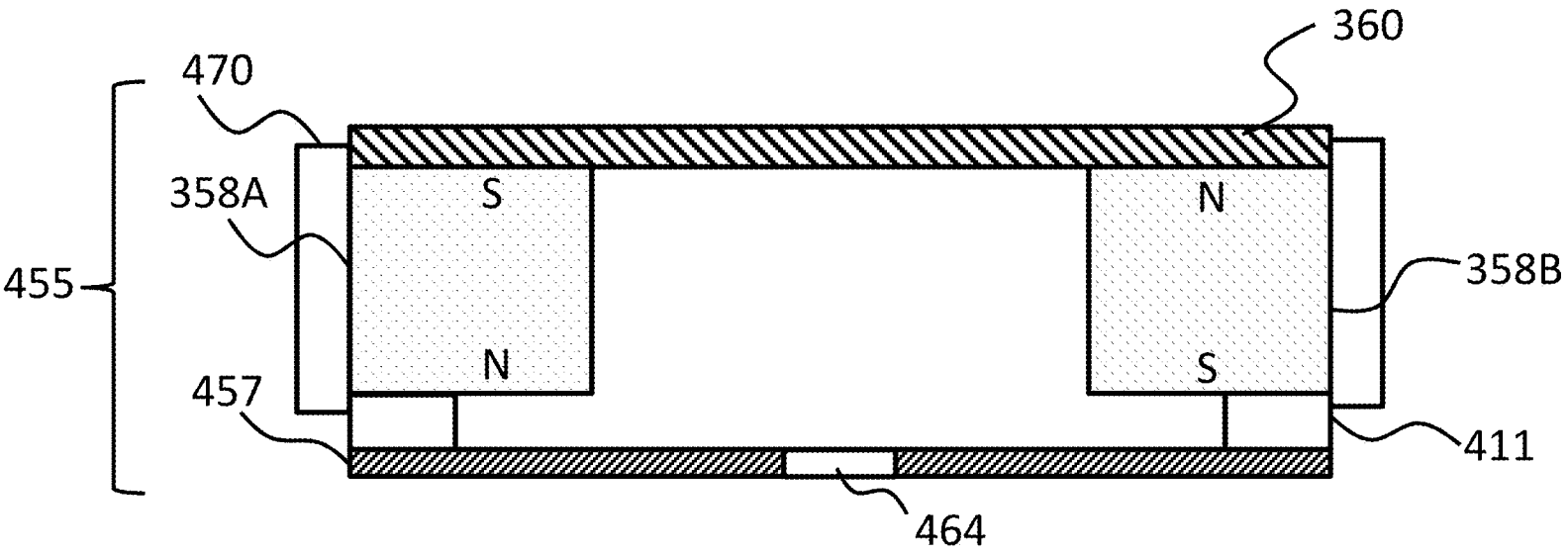
FIG. 4A is a schematic diagram illustrating components of an alternate embodiment of the embodiment of FIG. 3.

FIG. 4A illustrates a counterweight assembly 455 according to an exemplary embodiment. In this embodiment, counterweight assembly 455 corresponds to the counterweight assembly of the external device 340A of FIG. 3, except that it specifically utilizes a leaf spring 457.

Figure 4B:
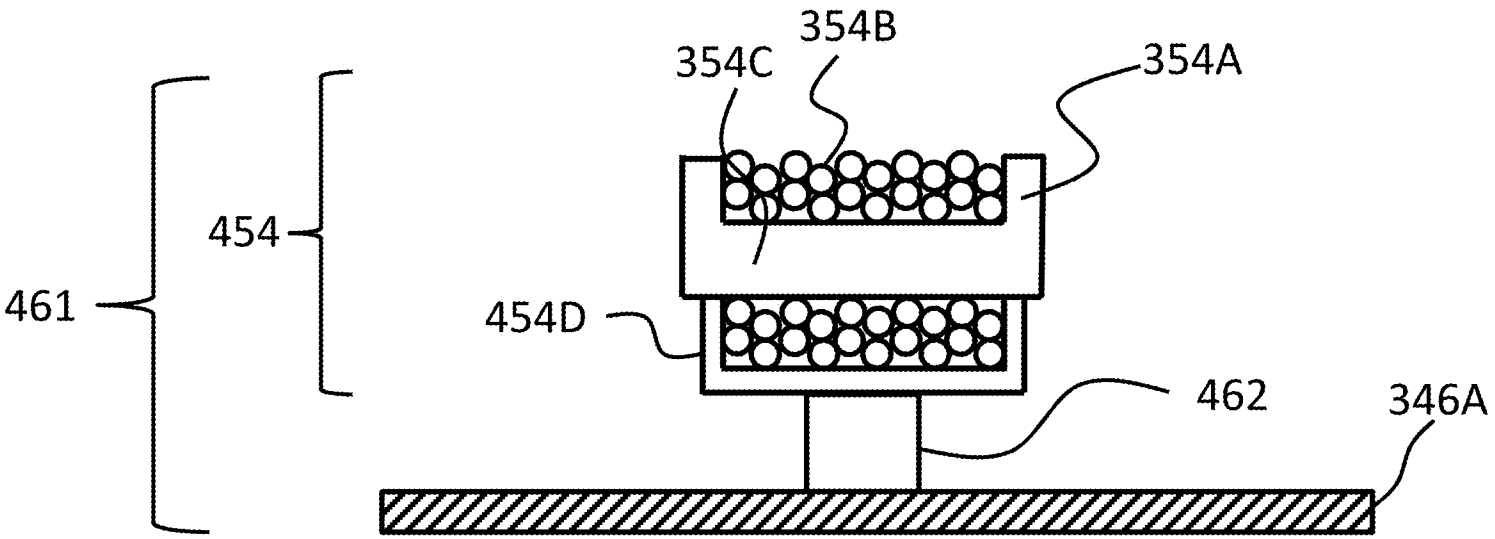
FIG. 4B is a schematic diagram illustrating additional components of an alternate embodiment of the embodiment of FIG. 3.

FIG. 4B illustrates a support plate assembly 461 according to an exemplary embodiment that is coupled to counterweight assembly 455 of FIG. 4A. In this embodiment, support plate assembly 461 corresponds to the support plate assembly of the external device of FIG. 340A of FIG. 3, except that it is configured differently to accommodate the leaf spring 457.

As illustrated, counterweight assembly 455 includes leaf spring 457, permanent magnets 358A and 358B, yoke 360, counterweight mass 370 and spacer(s) 411. Spring 457 connects bobbin assembly 454 to the rest of counterweight assembly 455. The bobbin assembly 454 has a bobbin support component 454D that is connected to shaft 462. Shaft 462 fits through hole 464 of spring 457. Spring 457 is connected to shaft 462 (e.g., at about the midpoint thereof). Spring 457 can be directly adhesively bonded, riveted, bolted, welded, etc., directly to the spacer(s) 411 and/or to any other component of the counterweight assembly 455 and can be welded, clamped, etc., to the shaft, so as to hold the components together/in contact with one another such that embodiments detailed herein and/or variations thereof can be practiced. Any device, system or method that can be utilized to connect the seismic mass components to the remainder of the external device can be utilized in at least some embodiments.

Shaft 462 supports the counterweight assembly 455 and supports the bobbin assembly relative to plate 346A. The shaft 462 and the bobbin assembly 454 and plate 346A are configured to permit the spring 457 to flex during normal operation (and, in at least some embodiments, extreme operation) without the spring coming into contact with the bobbin assembly and without the spring coming into contact with the plate 346A. Thus, the spring 457 permits the counterweight assembly 455 to move relative to bobbin assembly 454 upon interaction of a dynamic magnetic flux produced by the bobbin assembly 454.

Referring back to the embodiment of FIG. 3, the dynamic magnetic flux is produced by energizing coil 354B with an alternating current. The static magnetic flux is produced by permanent magnets 358A and 358B of counterweight assembly, as will be described in greater detail below. In this regard, the counterweight assembly of the external component 340A is a static magnetic field generator and bobbin assembly is a dynamic magnetic field generator.

As noted, bobbin assembly 354 is configured to generate a dynamic magnetic flux when energized by an electric current. In this exemplary embodiment, bobbin 354A is made of a soft iron. Coil 354B may be energized with an alternating current to create the dynamic magnetic flux about coil 354B. The iron of bobbin 354A is conducive to the establishment of a magnetic conduction path for the dynamic magnetic flux. Conversely, counterweight assembly, as a result of permanent magnets 358A and 358B, generate, due to the permanent magnets, a static magnetic flux. The soft iron of the bobbin and yokes may be of a type that increases the magnetic coupling of the respective magnetic fields, thereby providing a magnetic conduction path for the respective magnetic fields.

It is noted that the primary direction of relative motion of the counterweight assembly of the electromagnetic transducer is parallel to the longitudinal axis of the external component 340A and perpendicular to the dynamic magnetic flux magnetic axis of the electromagnetic actuator (discussed in greater detail below), and, with respect to utilization of the transducers in a bone conduction device, normal to the tangent of the surface of the skin 138 and/or bone 136 the pressure plate 346A. It is noted that by "primary direction of relative motion," it is recognized that the counterweight assembly may move inward towards the longitudinal axis of the electromagnetic actuator owing to the flexing of some components, but that most of the movement is normal to this direction.

Figure 5A:
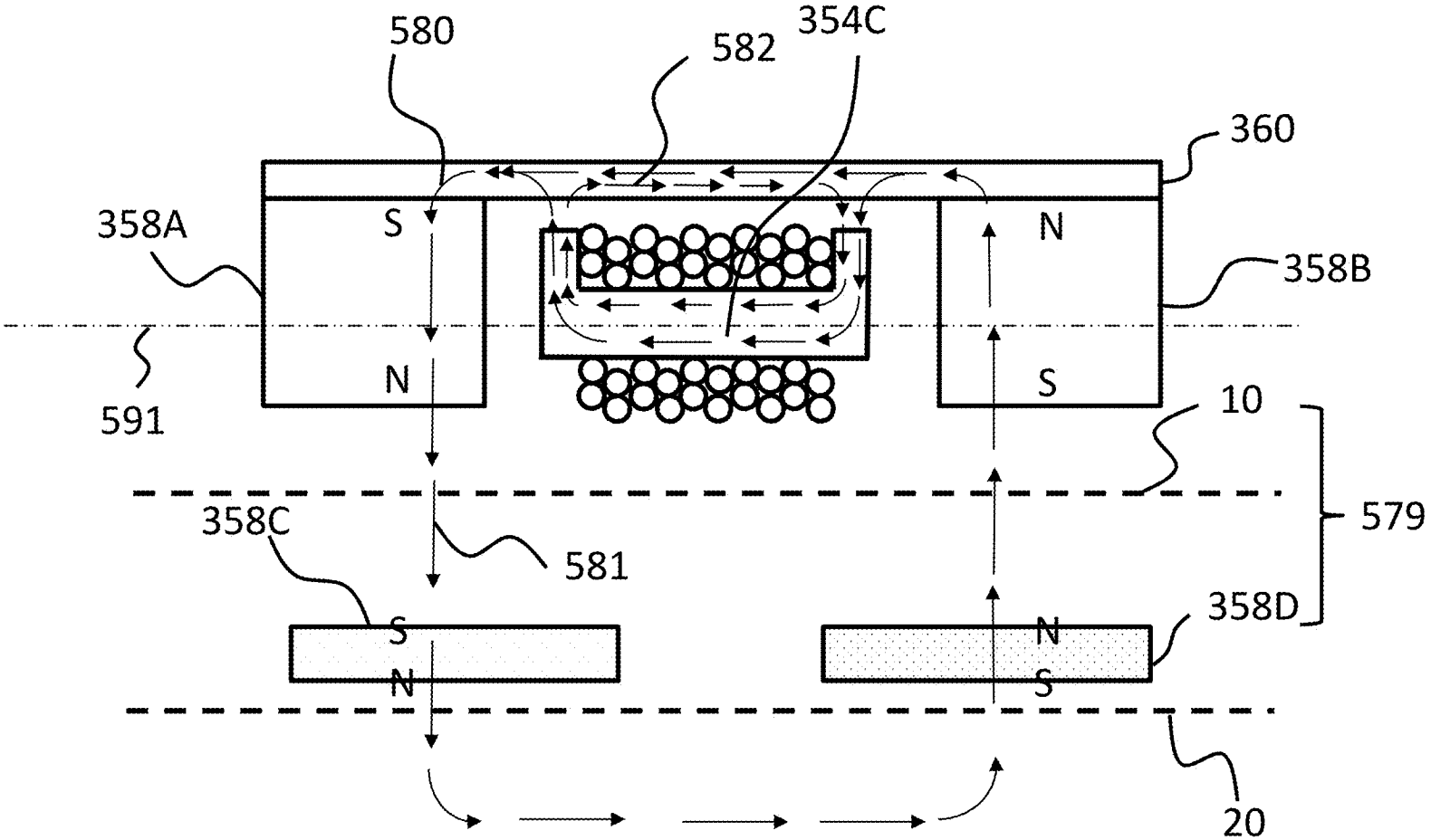
FIGS. 5A and 5B are schematic diagrams illustrating exemplary magnetic fluxes according to the embodiment of FIG. 3.

FIG. 5A is a schematic diagram detailing the static magnetic flux 580 created by permanent magnets 358A and 358B (and, optionally, 358C and 358D in embodiments where the implantable component 350A includes a permanent magnet and where such permanent magnets are utilized for the generation of a static magnetic flux that combines with that of the permanent magnets of the external component 340A) and dynamic magnetic flux 582 of coil 354B when coil 354B is energized according to a first current direction and when bobbin assembly and counterweight assembly are at a balance point with respect to magnetically induced relative movement between the two (hereinafter, the "balance point"). That is, while it is to be understood that the counterweight assembly moves in an oscillatory manner relative to the bobbin assembly when the coil 354B is energized, there is an equilibrium point at the fixed location corresponding to the balance point at which the counterweight assembly returns to relative to the bobbin assembly 354 when the coil 354B is not energized.

Figure 5B:
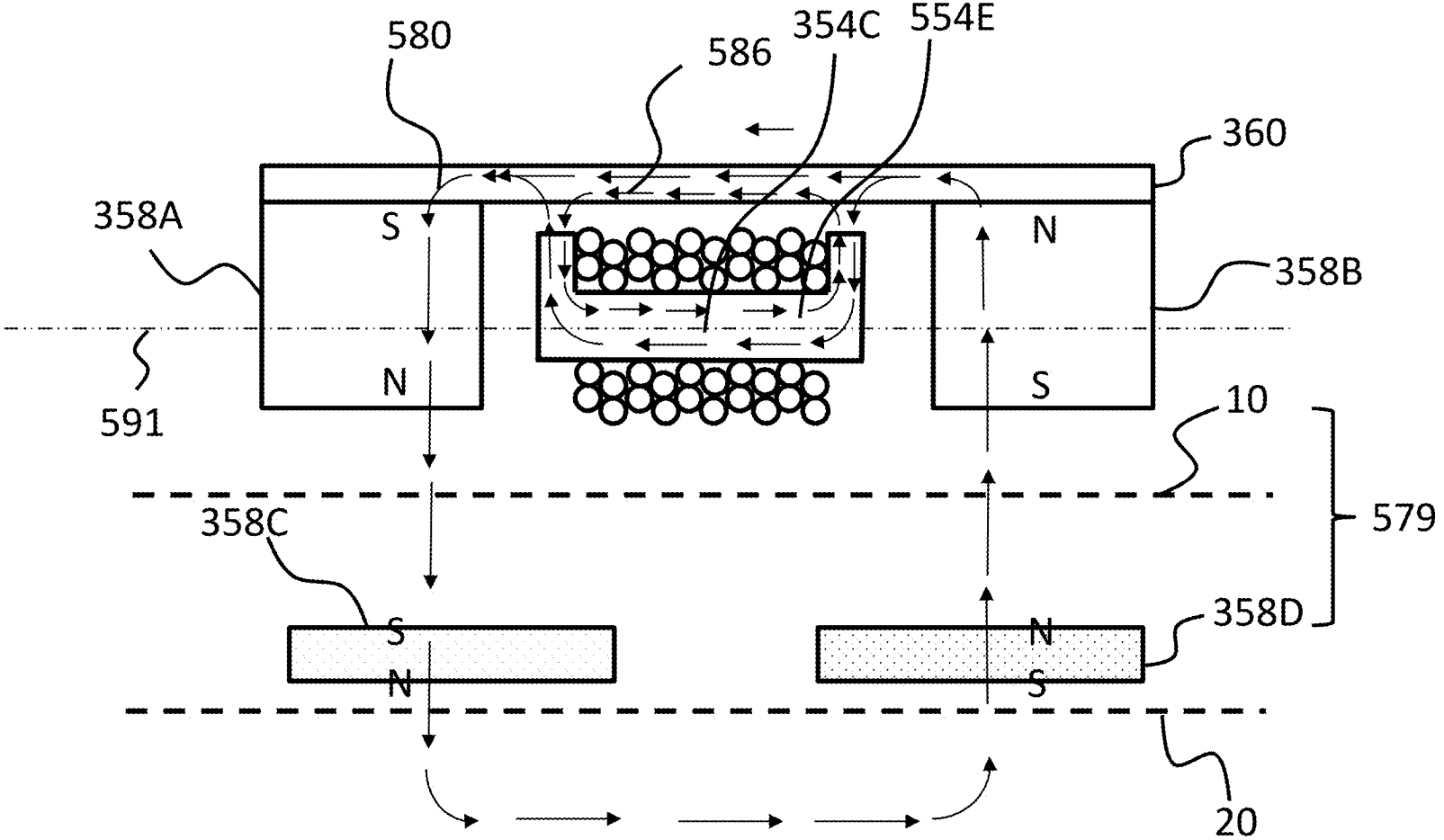

FIG. 5B is a schematic diagram detailing the static magnetic flux 580 of permanent magnets 358A and 358B (and 358C and 358D, if present and so utilized), and dynamic magnetic flux 586 of coil 354B when coil 354B is energized according to a second current direction (a direction opposite the first current direction) and when bobbin assembly and counterweight assembly are at a balance point with respect to magnetically induced relative movement between the two.

Figure 6A:
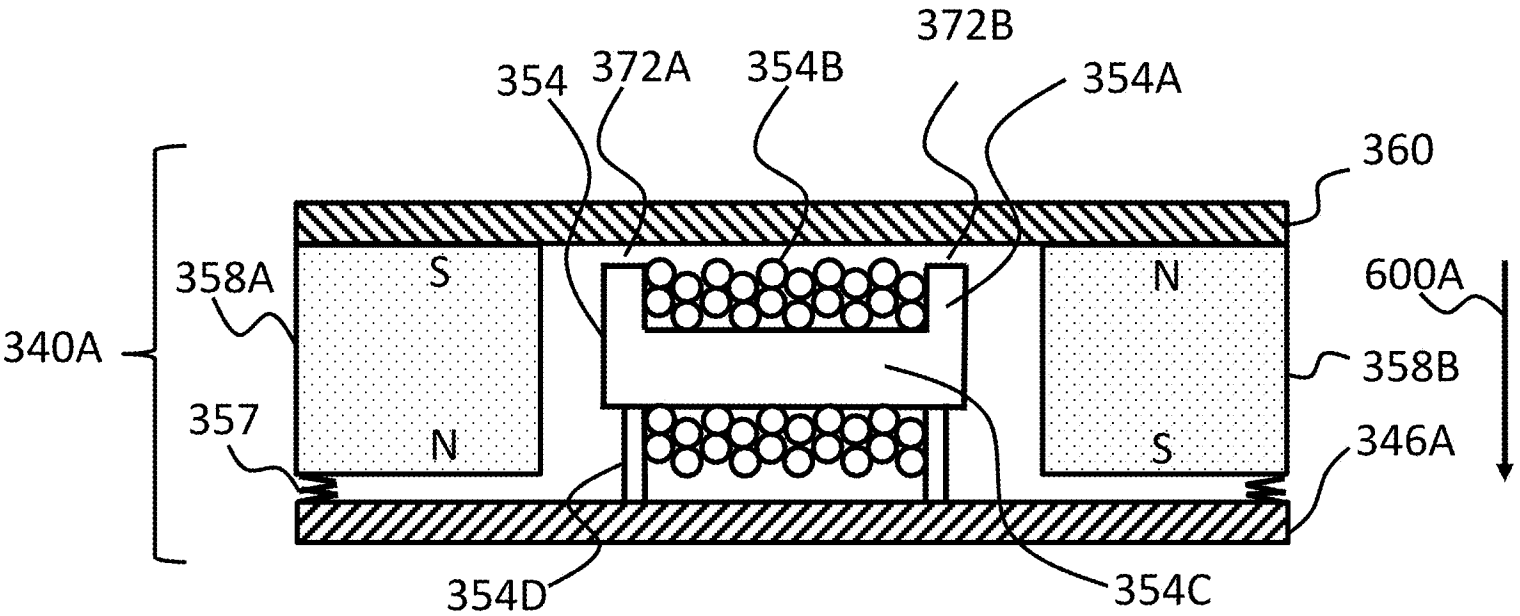
FIGS. 6A and 6B are schematic diagrams illustrating exemplary locations of components of the embodiment of FIG. 3 during operation thereof.

Referring now to FIG. 6A, the depicted magnetic fluxes 580 and 582 of FIG. 5A will magnetically induce movement of counterweight assembly downward (represented by the direction of arrow 600*a* in FIG. 6A) relative to bobbin assembly 354/the plate 346, thereby compressing the springs 357 relative to that depicted in FIG. 3 (which corresponds to the equilibrium point of the transducer, where the permanent magnets are attracted to the yoke 360 but the springs resist further movement theretowards) so that the external component 340A will ultimately correspond to the configuration depicted in FIG. 6A. More specifically, the vibrating electromagnetic actuator of the bone conduction device 340A is configured such that during operation of vibrating electromagnetic actuator (and thus operation of bone conduction device), an effective amount of the dynamic magnetic flux 582 and an effective amount of the static magnetic flux (flux 580) flow through the air gaps 372A and 372B sufficient to generate substantial relative movement between the counterweight assembly and bobbin assembly 654 (in the embodiment of FIG. 6A, thereby reducing the size of the air gaps relative to that depicted in FIG. 3 (which depicts the external component 340A at the balance point).

As used herein, the phrase "effective amount of flux" refers to a flux that produces a magnetic force that impacts the performance of vibrating electromagnetic actuator, as opposed to trace flux, which may be capable of detection by sensitive equipment but has no substantial impact (e.g., the efficiency is minimally impacted) on the performance of the vibrating electromagnetic actuator. That is, the trace flux will typically not result in vibrations being generated by the electromagnetic actuators detailed herein and/or typically will not result in the generation electrical signals in the absence of vibration inputted into the transducer.

As can be seen from the figures, the dynamic magnetic fluxes to not extend into the skin of the recipient, or at least no effective amount of dynamic magnetic flux extends into the skin of the recipient. Also as can be seen from the figures, the dynamic magnetic fluxes to not extend to the implantable component, or at least no effective amount of dynamic magnetic flux extends to the implantable component. Thus, in an exemplary embodiment, only the static magnetic flux (or at least only effective amounts of the static magnetic flux) extends into the skin of the recipient/extends to the implantable component.

Further, as may be seen in FIGS. 5A and 5B, the static magnetic flux 580 enters bobbin 354A substantially only at locations lying on and parallel to a tangent line of the path of the dynamic magnetic fluxes 582.

As may be seen from FIGS. 5A and 5B, no substantial amount of the dynamic magnetic flux 582 or 586 passes through the two permanent magnets 358A and 358B of the counterweight assembly. Moreover, as may be seen from the FIGS., the static magnetic flux (880) is produced by no more than two permanent magnets 358A and 358B (or by no more than four permanent magnets 358A, 358B, 358C and 358D, in the case where the implantable component includes permanent magnets).

It is noted that the directions and paths of the static magnetic flux and dynamic magnetic flux are representative of some exemplary embodiments, and in other embodiments, the directions and/or paths of the fluxes can vary from those depicted.

It is noted that the schematics of FIGS. 5A and 5B represent respective instantaneous snapshots while the counterweight assembly is moving in opposite directions (FIG. 5A being downward movement, FIG. 5B being upward movement), but both when the bobbin assembly 654 and counterweight assembly are at the balance point. As can be seen, when the actuator is at the balance point, air gaps 372A and 372B are present between the yoke 360 and the bobbin assembly 354. There is thus utilitarian value with respect to such a configuration having such a balance point in that the bobbin assembly 354 does not contact the yoke 360 when the device is not in operation, thereby increasing longevity. In an exemplary embodiment, the gap is sufficiently wide that even in the event of undesirable acceleration (e.g., dropping the actuator onto the floor or the like), the air gaps are not reduced to zero so as to limit the potential for damage due to the bobbin assembly 354 contacting the yoke.

Upon reversal of the direction of the dynamic magnetic flux, the dynamic magnetic flux will flow in the opposite direction about coil 354B. However, the general directions of the static magnetic flux will not change. Accordingly, such reversal will magnetically induce movement of counterweight assembly upward (represented by the direction of arrow 600B in FIG. 6B) relative to bobbin assembly 654/plate 346A so that the external component 340A will ultimately correspond to the configuration depicted in FIG. 6B. As the counterweight assembly moves upward relative to bobbin assembly 654, the span of air gaps 372A and 372B decreases.

Figure 6B:
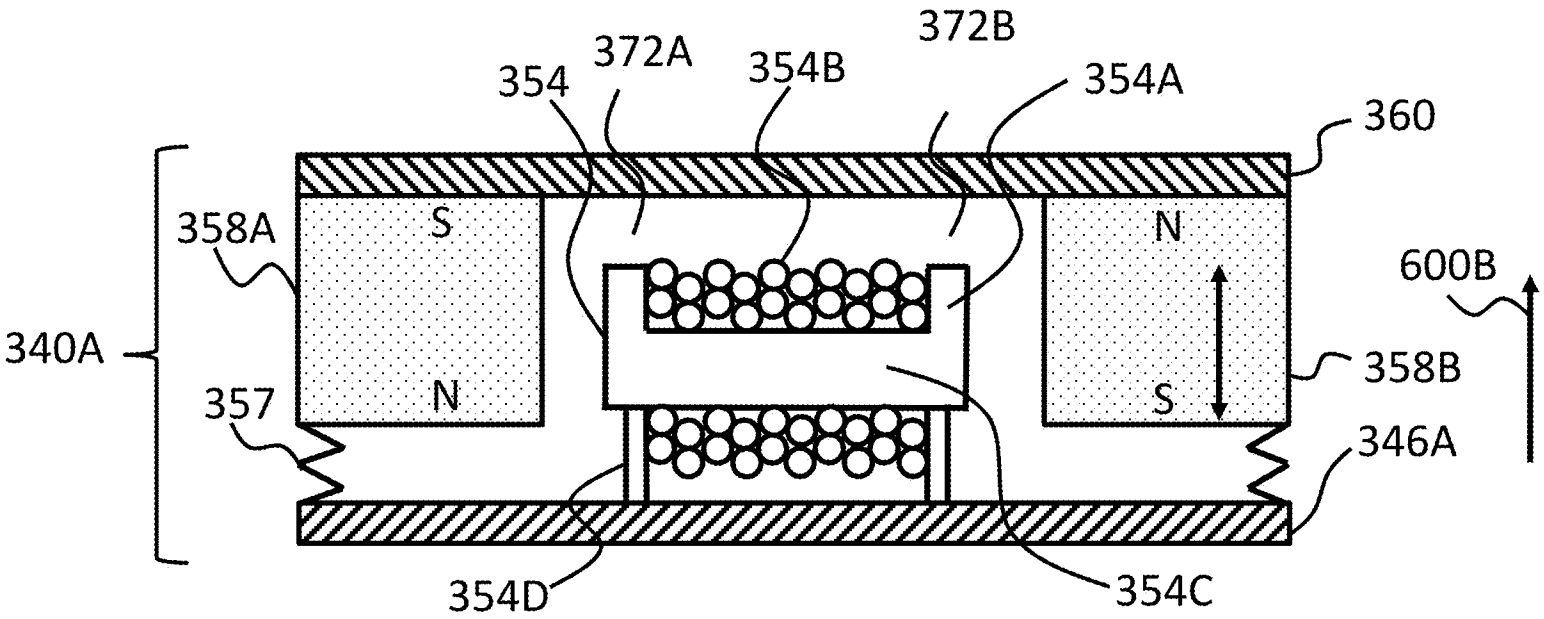

As can be seen from FIGS. 6A and 6B, the springs 357 deform with transduction of the transducer (e.g., actuation of the actuator).

It is noted that various features/components of the electromagnetic actuators detailed herein are described with reference to the dynamic magnetic flux magnetic axis of the electromagnetic actuator. FIG. 5A depicts the dynamic magnetic flux magnetic axis 591 according to an exemplary embodiment. As can be seen, when FIG. 5A is compared to FIG. 3, it can be seen that the dynamic magnetic flux magnetic axis 591 of the electromagnetic actuator is orthogonal to the longitudinal direction of the actuator (axis 390 of FIG. 3). Further, it is noted that the dynamic magnetic flux 582/586 is generated orthogonally to the magnetization axis of the permanent magnets 358A and 358B.

As can be seen from FIGS. 5A and 5B, the external component 340A includes one or more permanent magnets 358A and 358B that generate the static magnetic flux 580 with which the dynamic magnetic flux 582/586 interacts to actuate the actuator, where the static magnetic flux 580 interacts with the dynamic magnetic flux 582/586 outside the coil at least substantially more on a first side of the coil 354B then on a second side of the coil opposite the first side of the coil (where in the exemplary embodiment of FIG. 3, the second side of the coil 354B is the side of the coil closer to the plate 346A, and the first side of the coil 354B is the side of the coil 354B furthest from the plate 346A/closest to yoke 360). In the embodiment of FIG. 3, substantially all of the interaction occurs in the yoke 360. In an exemplary embodiment, about 70%, 75%, 80%, 85%, 90%, 95% or 100% or any value or range of values therebetween in about 1% increments (e.g., about 77%, about 83%, about 72% to about 98%, etc.) of the interactions between the static magnetic flux and the dynamic magnetic flux occurs on one side of the bobbin vs. that which occurs on another side of the bobbin (where respective sides can encompass 180 degrees about the dynamic magnetic flux magnetic axis).

In view of the above, it is noted that in at least some embodiments, the electromagnetic actuator configured such that the dynamic magnetic flux 582/586 and the static magnetic flux 580 flows through first air gaps 372A and 372B to interact with one another to actuate the actuator, where all of the first air gaps 372A and 372B are radial air gaps relative to the dynamic magnetic flux magnetic axis 591 of the electromagnetic actuator (and are axial air gaps relative to the longitudinal axis 390 of the electromagnetic actuator/the direction of movement 399 of the seismic mass). In an exemplary embodiment, the only air gaps in which the dynamic magnetic flux in the static magnetic flux interact are the first air gaps (i.e., only radial air gaps relative to the dynamic magnetic flux magnetic axis 591).

The phrase "radial air gap" is not limited to an annular air gap, and encompasses air gaps that are formed by straight walls of the components (which may be present in embodiments utilizing bar magnets and bobbins that have a non-circular (e.g. square) core surface). With respect to FIG. 3, the boundaries of axial air gap 372B are defined by surfaces of the bobbin 354A depicted in FIG. 3 as being closest to the yoke 360 (i.e., the "arms" of the bobbin 354A), and the surface(s) of the yoke 360 that are closest to the bobbin 354A. In an exemplary embodiment, the yoke 360 is a plate of uniform thickness. However, in an alternate embodiment, the yoke 360 can have "arms" that extend towards the arms of the bobbin 354A, and thus have respective surfaces that form respective one sides of respective air gaps 372A and 372B.

As noted above, bobbin assembly 354 is radially asymmetrical. More specifically, bobbin 354A is radially asymmetrical. Specifically, in the exemplary embodiment depicted in the figures, there are no arms of the bobbin (at least not arms that are made of material corresponding to yoke material/material that acts as a conduit for the dynamic magnetic flux) that extend towards the plate 346A. In an exemplary embodiment depicted in the figures, the arms of the bobbin (again, at least the arms of the bobbin that are made of material corresponding to yoke material/material that acts as a conduit for the dynamic magnetic flux) only extend towards the yoke 360 or only extend towards the yoke 360 and only extend laterally. In at least some embodiments, this has utility in that it directs the dynamic magnetic flux towards one side of the bobbin assembly (the side facing the yoke 360/the side facing away from the plate 346A relative to the dynamic magnetic flux magnetic axis 591) at least more so than the other side.

As can be seen from FIGS. 5A and 5B, the static magnetic flux 580 travels in a circuit 581 that crosses the outer surfaces of the skin 132 (represented by dashed line 10), fat 128 and muscle 134 layers of the recipient. The static magnetic flux 580 also crosses the outer surface of bone 136 (represented by dashed line 20). Accordingly, the electromagnetic actuator of bone conduction device 300A is configured to include, at least during operation of the bone conduction device 300A to evoke a hearing percept, a static magnetic flux air gap that extends through skin of the recipient. (The air gap may also exist when the bone conduction device 300A is not operating to evoke a hearing percept, but instead simply adhered to skin of the recipient via the static magnetic flux 580.) In at least some exemplary embodiments, only trace amounts, if any, of the dynamic magnetic flux flows into the skin of the recipient. Accordingly, the electromagnetic actuator includes a second air gap 579 through which a substantial amount of the static magnetic flux flows and through which only trace amounts, if any, of the dynamic magnetic flux flows, at least during actuation of the actuator. In an exemplary embodiment, the bone conduction device is configured such that during operation of the bone conduction device to evoke a bone conduction hearing percept, air gap 579 extends beyond the external component, and, in some embodiments, the air gap 579 extends from the external component 340A to the internal component 350A. In this regard, there is a bone conduction device such as bone conduction device 300A, that includes a component (e.g., internal component 350A) free of mechanical connection to the actuator, the component including ferromagnetic material (e.g., soft iron, a permanent magnet, etc.), where the static magnetic flux 580 flows in a circuit 581 that is closed by the ferromagnetic material of the component 350A.

Thus, the bone conduction device 300A includes an external component 340A including the two permanent magnets 358A and 358B (it can include more than two, as long as the component includes two), wherein the external component 340A is configured to generate a dynamic magnetic flux 582/586 that interacts with the static magnetic flux 580 to actuate the actuator. The bone conduction device 300A is further configured such that a substantial amount of the static magnetic flux 580 flows in a circuit 581 that extends through a surface of skin of the recipient (represented by dashed line 10) of the bone conduction device 300A when the external component 340A is placed against the recipient. In an exemplary embodiment, about 70%, 75%, 80%, 85%, 90%, 95% or about 100% of the static magnetic flux 580 generated by the electromagnetic actuator 340A flows in a circuit that extends through the skin of the recipient.

Also as can be seen from FIGS. 5A and 5B, the static magnetic flux 580 is asymmetrical. In an exemplary embodiment, as can be seen from FIGS. 5A and 5B, the static magnetic flux 580 flows in one direction in one circuit (circuit 581), and there is not another static magnetic flux circuit that flows in an opposite direction, at least not one that would render the static magnetic flux to be symmetrical. Further, as can be seen from FIGS. 5A and 5B, the external component 340A is configured such that the static magnetic flux flows in a circuit (circuit 581) that encompasses the two permanent magnets 358A and 358B and at least one yoke (yoke 360) that is a part of the external component. A substantial portion of the static magnetic flux 580 that flows in the circuit 581 flows through at least one of an implantable permanent magnet (358C and/or 358D or a second yoke (where permanent magnets 358C and 358D of the figures is replaced with a ferromagnetic material such as soft iron etc., as noted above) that is implantable. In an exemplary embodiment, at least about 70%, 75%, 80%, 85%, 90%, 95% or about 100% or any value or range of values therebetween in about 1% increments of the static magnetic flux of the external component flows through an implantable component. In an exemplary embodiment, the implantable component also generates a static magnetic flux that is additive to the magnetic flux generated by the external component 340A and/or serves as a yoke to guide to magnetic flux generated by the external component 340A in the circuit.

More specifically, exemplary embodiments include a passive transcutaneous bone conduction device 300A including an electromagnetic actuator configured to generate a static magnetic flux 580 and a dynamic magnetic flux 582/586 that interacts with the static magnetic flux to actuate the actuator, as detailed above. In at least some exemplary embodiments, the external component 340A is configured to generate the dynamic magnetic flux 582/586, and the internal component 359A is configured to generate at least a portion of the static magnetic flux.

Accordingly, in an exemplary embodiment, the implantable component 350A of the passive transcutaneous bone conduction device 300A comprises ferromagnetic material (permanent magnets or otherwise). The passive transcutaneous bone conduction device 300A is configured such that the static magnetic flux extends through skin 132 of the recipient to the implantable component 350A, resulting in magnetic attraction between the external component 340A and the implantable component 350A. In an exemplary embodiment, the magnetic flux so extended is strong enough to removably retain the external component to the recipient. By removably retain, it is meant that the external component 340A is adhered to the recipient in a manner such that the external component will be retained to the recipient during normal life activities (e.g., walking, walking down stairs, etc.) but is removed upon the application of a force having a vector in a direction away from the recipient that is below that which would result in damage to the external component 340A. In an exemplary embodiment, the removable component 340A can be exposed to at least a two G environment (normal to the direction of gravity) when the recipient is standing without the external component 340A being removed from the recipient (although some readjustment of location may be utilitarian).

In view of FIGS. 5A and 5B, the external component 340A is configured to generate a dynamic magnetic flux 582 and 586 that interacts with the static magnetic flux 580 to actuate the actuator (the transducer) of the bone conduction device 300A.

Figure 7:
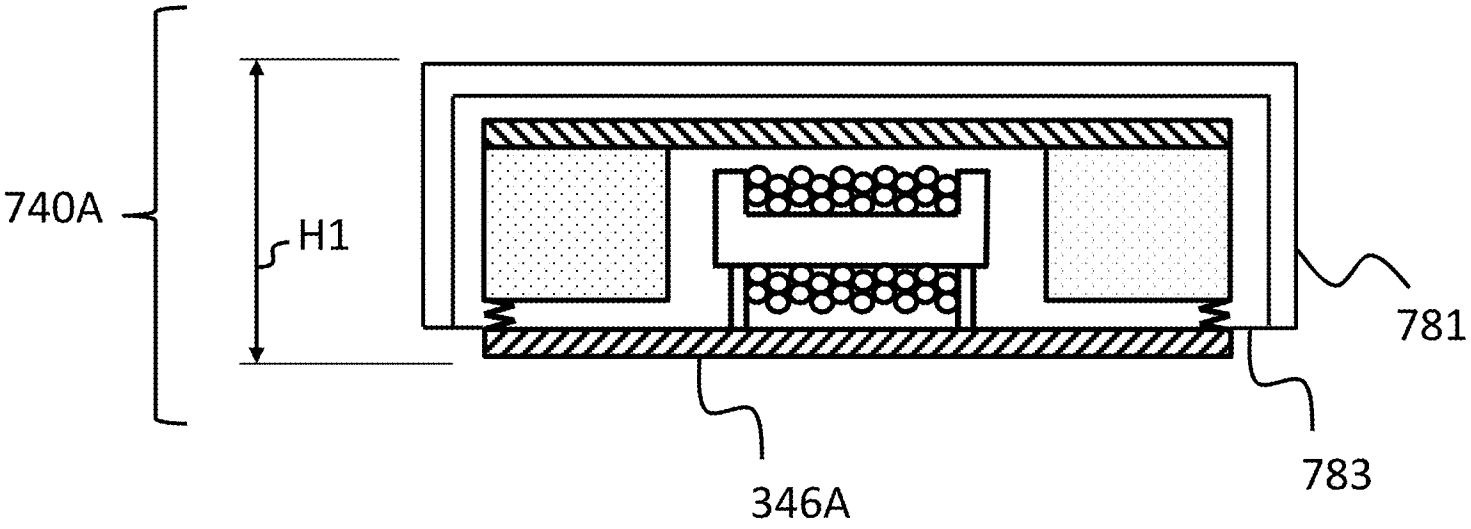
FIG. 7 depicts an alternate embodiment of the embodiment of FIG. 3.

Embodiments of at least some of the teachings detailed herein and/or variations thereof can have utility in that it provides a compact external device. More specifically, referring to FIG. 7, another exemplary external component 740A is depicted. Component 740A corresponds to any of the external components detailed herein and/or variations thereof with the addition of a housing 781 suspended from the plate 346A via a leaf spring 783 to vibrationally isolate the housing 781 from the rest of the external component (e.g., the support plate assembly and the counterweight assembly). More specifically, FIG. 7 depicts the overall height H1 of the external component 740A, as dimensioned from a first surface of external component configured to contact skin of the recipient (e.g. the bottom of plate 346A) to the top of the housing 781. In an exemplary embodiment, the height H1 is no more than about 7 mm, 8 mm, 9 mm, 10 mm, 11 mm, 12 mm, 13 mm, 14 mm or about 15 mm.

In at least some embodiments, the distance between the aforementioned first surface configured to contact skin of the recipient to the center of mass/center of gravity of the external component 740A is no more than about 3 mm, 4 mm, 5 mm, 6 mm, 7 mm, 8 mm, 9 mm or about 10 mm.

In at least some exemplary embodiments, the aforementioned height values alone and/or in combination with the reduced overall weight of the external component can have utility in that the lever effect can be reduced relative to that which might otherwise be the case without the aforementioned features without decreasing performance, again relative to that which might otherwise be the case without the aforementioned features. By way of example only and not by way limitation, by reducing the lever effect, the peak pressures at the bottom portions of the pressure plate relative to the direction of gravity can be reduced (e.g., because the moment about the external component resulting from the mass thereof and/or the distance of the center of gravity/center of mass thereof from the skin is reduced relative to that which might otherwise be the place). In an exemplary embodiment, this can reduce the chances of necrosis or the like and/or reduce the sensation of pinching or the like relative to that which would be the case for the aforementioned alternate configuration.

Again with reference back to FIG. 7, it is noted while the exemplary embodiment depicted in that figure is such that housing 781 is connected by spring 783 to plate 346A, in an alternate embodiment, the housing 781 can be included as part of the counterweight/seismic mass. That is, instead of the housing 781 being connected to the plate 783 by spring, the housing 781 is connected to the counterweight assembly (e.g. to one or both of the permanent magnets, the yoke, etc.). Indeed, in at least some exemplary embodiments, one or more or all of the housing, electronics (e.g. sound processor, etc.) battery, or microphones (which, in some embodiments, are MEMS microphones) are part of the seismic mass/counterweight assembly.

Is further noted that some embodiments include a method of retrofitting a passive transcutaneous bone conduction system with an external component according to the teachings detailed herein and/or variations thereof. For example, in an exemplary method, there is an action of identifying a recipient utilizing an external component of a passive transcutaneous bone conduction device that includes a pressure plate that is or includes a permanent magnet that is utilized to removably retain the external component to the recipient. Still further, in this exemplary method, there is a further action of providing an external component including one or more or all of the teachings detailed herein and/or variations thereof, to the recipient, and, optionally, instructing the recipient to utilize the provided external component in place of the external component having the aforementioned plate with a permanent magnet.

It is noted that different skin thicknesses of different recipients (e.g., the distance between the outer surface of skin 132 and the top surface (surface closest to skin 132), and thus "skin thickness" is determined by more than just the skin, but also fat and muscle thickness) can impact the performance of the actuators/transducers disclosed herein. By way of example only and not by way of limitation, in some exemplary embodiments, the spring stiffness (stiffness of springs 357, 457, etc.) would be stiffer the thinner the skin thickness (e.g., a "thick skinned" person would have a relatively more compliant spring system than that of a "thin skinned" person). Accordingly, an exemplary embodiment utilizes non-linear springs 357/457 that alleviate performance variation due to skin thickness. Alternatively or in addition to this, exemplary embodiments can utilize a system that adjusts the spring stiffness. (This can be done manually during a quasi-fitting operation and/or or can be done automatically by an on-board control system). That said, in an alternate embodiment, the springs are exchangeable (e.g., a stiff spring is swapped out for a compliant spring when the bone conduction device is to be used on a thick-skinned person, and visa-versa (if the device initially has a compliant spring).

As noted above, some and/or all of the teachings detailed herein can be used with a passive transcutaneous bone conduction device. Thus, in an exemplary embodiment, there is a passive transcutaneous bone conduction device including one or more or all of the teachings detailed herein that is configured to effectively evoke hearing percept. By "effectively evoke a hearing percept," it is meant that the vibrations are such that a typical human between 18 years old and 40 years old having a fully functioning cochlea receiving such vibrations, where the vibrations communicate speech, would be able to understand the speech communicated by those vibrations in a manner sufficient to carry on a conversation provided that those adult humans are fluent in the language forming the basis of the speech. In an exemplary embodiment, the vibrational communication effectively evokes a hearing percept, if not a functionally utilitarian hearing percept.

It is noted that any disclosure with respect to one or more embodiments detailed herein can be practiced in combination with any other disclosure with respect to one or more other embodiments detailed herein (e.g., any disclosures herein regarding the embodiment of FIG. 3 can be practiced with the embodiment of FIGS. 4A and 4B, etc.), at least unless specified herein to the contrary.

It is noted that some embodiments include a method of utilizing a bone conduction device including one or more or all of the teachings detailed herein and/or variations thereof. In this regard, it is noted that any disclosure of a device and/or system herein also corresponds to a disclosure of utilizing the device and/or system detailed herein, at least in a manner to exploit the functionality thereof. Further it is noted that any disclosure of a method of manufacturing corresponds to a disclosure of a device and/or system resulting from that method of manufacturing. It is also noted that any disclosure of a device and/or system herein corresponds to a disclosure of manufacturing that device and/or system.

While various embodiments have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. An apparatus, comprising:

an external component of a medical device including an electromagnetic actuator, wherein static magnetic flux of the electromagnetic actuator removably retains the external component to a recipient thereof, the external component includes a first surface configured to contact skin of the recipient through which vibrations generated by the actuator are conducted into skin of the recipient, the external component includes at least one permanent magnet that generates the static magnetic flux, and the electromagnetic actuator is configured to drive the permanent magnet in an oscillatory manner in a direction towards and away from the first surface to generate vibrations.

2. The apparatus of claim 1, wherein:

the apparatus is a passive transcutaneous bone conduction device configured to effectively evoke a hearing percept; and the external component is an external component of the passive transcutaneous bone conduction device.

3. The apparatus of claim 2, further comprising:

an implantable component of the passive transcutaneous bone conduction device comprising ferromagnetic material, wherein the apparatus is configured such that the static magnetic flux extends through skin of the recipient to the implantable component resulting in magnetic attraction between the external medical device component and the implantable component, thereby removably retaining the external component to the recipient.

4. The apparatus of claim 2, wherein:

the external component includes permanent magnets configured to generate the static magnetic flux, wherein the permanent magnets are part of a seismic mass of the external component and generate the static magnetic flux to removably retain the external component to a recipient.

5. The apparatus of claim 2, wherein:

the external component includes a first surface configured to contact skin of the recipient through which vibrations generated by the actuator are conducted into skin of the recipient; and a height of the external component as dimensioned from the first surface is no more than about fifteen millimeters.

6. The apparatus of claim 1, wherein:

the external component is configured to generate a dynamic magnetic flux that interacts with the static magnetic flux in the external component to actuate the actuator.

7. The apparatus of claim 6, wherein:

the external component includes one or more permanent magnets that generate the static magnetic flux with which the dynamic magnetic flux interacts to actuate the actuator;

the dynamic magnetic flux is generated by applying electrical current to a coil; and the static magnetic flux interacts with the dynamic magnetic flux outside the coil at least substantially more on a first side of the coil then on a second side of the coil opposite the first side of the coil.

8. The apparatus of claim 7, wherein the second side is a side that faces a side of the external component that is located closest to the recipient when attached thereto during operation of the medical device.

9. An apparatus, comprising:

a bone conduction device, including:

an electromagnetic actuator including two permanent magnets that generate static magnetic flux and that are aligned with one another at least about at a same location along a longitudinal axis of the actuator and arranged such that respective North-South poles of respective permanent magnets face opposite directions relative to the longitudinal axis, wherein the electromagnetic actuator is configured to generate a dynamic magnetic flux that interacts with the static magnetic flux to generate vibrations; and a dynamic magnetic flux magnetic axis of the electromagnetic actuator is orthogonal to the longitudinal direction of the actuator, wherein the bone conduction device further comprises a coil, wherein the bone conduction device is configured such that the application of electrical current thereto generates a dynamic magnetic flux that interacts with the two permanent magnets, wherein at least one of:

(i) the coil is located between a first magnet of the two permanent magnets and a second magnet of the two permanent magnets; or (ii) the coil is wound about a first longitudinal axis that is normal to respective longitudinal magnetic axes extending through the respective North-South poles, and wherein with respect to location along the longitudinal magnetic axes, the first longitudinal axis is located between ends of the respective magnets where the respective North and South poles are located.

10. The apparatus of claim 9, further including:

an implantable component free of mechanical connection to the at least two permanent magnets, the component including ferromagnetic material, where the static magnetic flux flows in a circuit that is closed by the ferromagnetic material of the component.

11. The apparatus of claim 9, wherein:

the bone conduction device includes an external component including the two permanent magnets, wherein the external component is configured to generate a dynamic magnetic flux that interacts with the static magnetic flux to actuate the actuator; and the bone conduction device is configured such that a substantial amount of the static magnetic flux flows in a circuit that extends through a surface of skin of a recipient of the bone conduction device when the external component is against the recipient during operation of the bone conduction device.

12. The apparatus of claim 9, wherein:

the static magnetic flux is asymmetrical.

13. The apparatus of claim 9, wherein:

the bone conduction device includes an external component including the two permanent magnets, wherein the static magnetic flux flows in a circuit that encompasses the two permanent magnets and at least one first yoke that is a part of the external component; and a substantial portion of the static magnetic flux flowing in the circuit flows through at least one of an implantable permanent magnet or a second yoke that is implantable.

14. The apparatus of claim 9, wherein:

the actuator is configured to include, at least during operation of the bone conduction device to evoke a hearing percept, a static magnetic flux gap in which no magnetic material is located that extends through skin of the recipient.

15. The apparatus of claim 9, wherein:

the electromagnetic actuator is configured to generate a dynamic magnetic flux that interacts with the static magnetic flux to generate vibrations; and the dynamic magnetic flux and the static magnetic flux flow through first air gaps to interact with one another to actuate the actuator, all of the first air gaps being radial air gaps relative to a dynamic magnetic flux magnetic axis of the electromagnetic actuator.

16. The apparatus of claim 9, wherein the coil is located between the first magnet of the two permanent magnets and the second magnet of the two permanent magnets.

17. The apparatus of claim 9, wherein the coil is wound about the first longitudinal axis that is normal to respective longitudinal magnetic axes extending through the respective North-South poles, and wherein with respect to location along the longitudinal magnetic axes, the first longitudinal axis is located between ends of the respective magnets where the respective North and South poles are located.

18. An apparatus, comprising:

a passive transcutaneous bone conduction device including an electromagnetic actuator configured to generate a static magnetic flux and a dynamic magnetic flux that interacts with the static magnetic flux to actuate the actuator, wherein the device includes an external component configured to generate the dynamic magnetic flux and at least a portion of the static magnetic flux via at least two permanent magnets, the device includes an implantable component configured to generate at least another portion of the static magnetic flux, the static magnetic flux generated by the implantable component extends across a first space located entirely between the implantable component and the at least two permanent magnets of the external component, and the external component is configured such that the dynamic magnetic flux extends across two air gaps to a yoke that magnetically channels the static magnetic flux from a first of the at least two permanent magnets to a second of the at least two permanent magnets such that only at most trace amounts of the dynamic magnetic flux flows through the first space during actuation of the actuator.

19. The apparatus of claim 18, wherein the electromagnetic actuator includes a gap in which no magnetic material is located through which a substantial amount of the static magnetic flux flows and through which only at most trace amounts of the dynamic magnetic flux flows during actuation of the actuator.

20. The apparatus of claim 19, wherein:

the external component is configured to generate at least a portion of the static magnetic flux, wherein the bone conduction device is configured such that during operation of the bone conduction device to evoke a hearing percept via bone conduction, the gap extends beyond the external component.

21. The apparatus of claim 19, wherein:

the bone conduction device includes an external component and an implantable component, wherein the gap extends from the external component to the internal component.

22. The apparatus of claim 18, wherein:

the passive transcutaneous bone conduction device is configured to limit vibratory output to frequencies below a value between about 5 kHz to about 8 kHz.

23. The apparatus of claim 18, wherein:

the passive transcutaneous bone conduction device is configured to limit vibratory output to frequencies below a value of about 7 kHz.

24. The apparatus of claim 18, wherein:

the passive transcutaneous bone conduction device is configured to limit vibratory output to frequencies below a value of about 8 kHz.

25. The apparatus of claim 18, wherein:

the passive transcutaneous bone conduction device has a seismic mass supported by one or more springs; and at least one of:

a spring stiffness of the one or more springs is adjustable; or a spring stiffness of the one or more springs is nonlinear.

26. The apparatus of claim 18, wherein all air gaps of the apparatus across which the dynamic magnetic flux flows have a width that extends in a direction parallel to a direction of extension of a longitudinal axis of the apparatus extending from the external component to the implantable component.

* * * * *